US006082766A

United States Patent [19]

Rodet et al.

[11] Patent Number: 6,082,766

[45] Date of Patent: Jul. 4, 2000

[54] ARTICULATED BOGEY FRAME AND AN ARTICULATED BOGEY INCLUDING SUCH A FRAME

[75] Inventors: Alain Rodet; Stéphane Brun, both of Le Creusot, France

[73] Assignee: GEC Alstrom Transport SA, Paris, France

[21] Appl. No.: 08/944,178

[22] Filed: Oct. 6, 1997

[30] Foreign Application Priority Data

Oct. 7, 1996 [FR] France ..... 96 12189

[51] Int. Cl.[7] ..... B62D 21/00

[52] U.S. Cl. ..... 280/781

[58] Field of Search ..... 280/781, 785, 280/797; 105/3, 4.2, 182.1, 167, 175.1; 180/311, 312, 291, 292

[56] References Cited

U.S. PATENT DOCUMENTS

| | | | |
|---|---|---|---|
| 3,398,700 | 8/1968 | Baker . | |
| 4,285,280 | 8/1981 | Smith | 105/168 |
| 4,398,468 | 8/1983 | Bell et al. | 105/136 |
| 4,593,625 | 6/1986 | Shimizu | 105/182 |
| 5,086,706 | 2/1992 | Bolvin | 105/168 |

FOREIGN PATENT DOCUMENTS

| | | |
|---|---|---|
| 0 114 940 A2 | 8/1984 | European Pat. Off. . |
| 0 557 892 A2 | 9/1993 | European Pat. Off. . |

*Primary Examiner*—Christopher P. Ellis
*Assistant Examiner*—Kevin McKinley
*Attorney, Agent, or Firm*—Sughrue, Mion, Zinn, Macpeak & Seas, PLLC

[57] ABSTRACT

An articulated bogey frame includes a right side a beam, a left side beam, a front beam, a rear beam, and a hinge mechanism, wherein the bogey frame is made up of two half-frames, each of said half-frames being generally L-shaped.

10 Claims, 2 Drawing Sheets

ARTICULATED BOGEY FRAME AND AN ARTICULATED BOGEY INCLUDING SUCH A FRAME

The present invention concerns bogeys in general and relates, more particularly, to an articulated bogey frame and to an articulated bogey including such a frame.

BACKGROUND OF THE INVENTION

Bogeys using an articulated frame have the advantage of better ground contact for all four wheels of the bogey in particular when passing over distortion of the track: at a transition between a straight and a canted curve; or when passing over track defects.

In the prior art, articulated frames for bogeys comprise two length members and two cross-members, each of the cross-members being secured to one of the length members via a hinge device.

The hinge devices enable each assembled-together length-member and cross-member pair to pivot about the axis defined by the two hinge devices.

FIG. 9 of document U.S. Pat. No. 3,398,700 shows a bogey including an articulated bogey frame comprising a right side beam, a left side beam, a front beam, and a rear beam, the right and left side beams being respectively secured to the front and rear beams, and hinge means disposed respectively between the right and left side beams and the front and rear beams.

Such a prior art bogey frame is shown diagrammatically in accompanying FIG. 1.

The prior art bogey frame is constituted by two hinged-together elements that are generally T-shaped.

The way in which the prior art bogey frame is articulated makes it possible to simplify the so-called "primary" suspension between the axles and the length members.

A major drawback of the prior art articulated bogey is that it does not make it possible to eliminate the primary suspension altogether since each axle is subjected to angular displacement relative to the two length members.

This is because each axle is associated with two half-frames.

The merit of the Applicant lies in proposing a bogey frame made up of two half-frames, in which each of the half-frames is generally L-shaped.

Another drawback of prior art articulated bogey frames is that they are still too bulky.

OBJECTS AND SUMMARY OF THE INVENTION

Thus an object of the invention is to provide an articulated bogey frame and an articulated bogey including such a frame that do not present the major drawback of prior art articulated bogey frames.

The Applicant thus has the merit of proposing an articulated bogey that does not include primary suspension because the bogey frame is made up of two half-frames interconnected by two hinge means capable of accommodating relative movements due to track defects.

According to the invention, an articulated bogey frame comprises a right side beam, a left side beam, a front beam, a rear beam, and hinge means, and the bogey frame is made up of two half-frames, each of said half-frames being generally L-shaped.

The articulated bogey frame of the invention may also satisfy at least one of the following characteristics:

said generally L-shaped half-frames are hinged together in or substantially in vertical planes containing the axles;

one of the ends of each of said right and left side beams is secured to a respective one of said front and rear beams, first hinge means being disposed between the other end of said right side beam and said front or rear beam, and second hinge means being disposed between the other end of said left side beam and said rear or front beam;

the primary suspension is replaced by said hinge means;

said right side beam and said front or rear beam form a first half-frame, and said left side beam and said rear or front beam form a second half-frame; and said first and second half-frames are identical.

The invention also provides a bogey which includes an articulated bogey frame as defined above.

The bogey of the invention may also satisfy at least one of the following characteristics:

each half-frame supports a traction motor, a set of gears, a differential, and an axle;

said sets of gears, said differentials, and said axles are integrated in their respective half-frames;

said sets of gears are integrated at least in part within the respective intersections between said right and left side beams and said corresponding front and rear beams;

said axles are integrated in said respective front and rear beams;

said differentials are integrated within the respective intersections between said right and left side beams and said respective front and rear beams; and the bogey includes a load-bearing center plate secured to said right and left side beams.

An advantage of the articulated bogey frame and of the articulated bogey including such a frame of the invention is a reduction in wheel base.

Another advantage of the articulated bogey frame and of the articulated bogey including such a frame of the invention is a reduction in the number of parts constituting the bogey.

Another advantage of the articulated bogey frame and of the articulated bogey including such a frame of the invention is a considerable saving in mass.

Another advantage of the articulated bogey frame and of the articulated bogey including such a frame of the invention is a reduction in cost.

Another advantage of the articulated bogey frame and of the articulated bogey including such a frame of the invention is the ease with which the tire of a wheel can be changed.

Another advantage of the articulated bogey frame and of the articulated bogey including such a frame of the invention is that it enables the transmission system to be highly modular.

Another advantage of the articulated bogey frame and of the articulated bogey including such a frame of the invention is that auxiliary equipment can be installed on the front and rear beams.

Another advantage of the articulated bogey frame and of the articulated bogey including such a frame of the invention is the way in which a carrying bogey can be obtained merely by omitting the motor and the transmission members internal to the frame.

BRIEF DESCRIPTION OF THE DRAWINGS

Other objects, characteristics, and advantages of the invention appear on reading the following description of preferred embodiments of the articulated bogey frame and of the articulated bogey including such a frame, which description is given with reference to the accompanying drawings, in which.

MORE DETAILED DESCRIPTION

Figure 1:
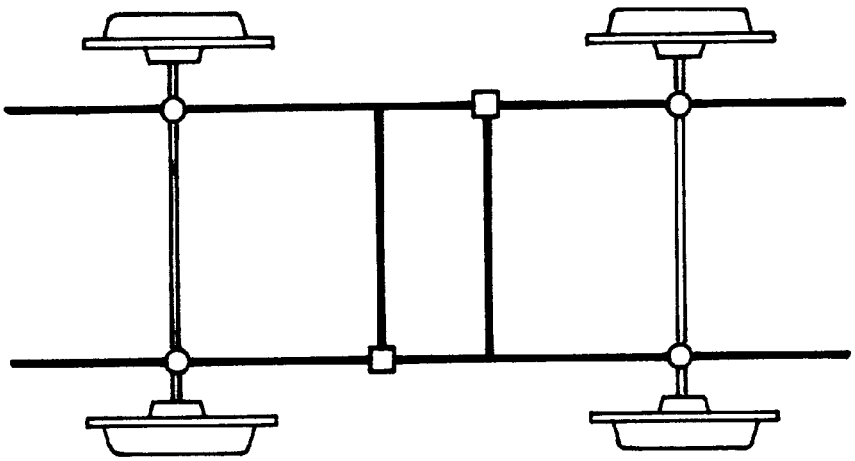
FIG. 1 is a diagram of the above-described prior art bogey frame.

FIG. 1 is a diagram of the above-described prior art bogey frame.

The bogey frame of the invention is constituted by two generally L-shaped elements that are hinged together in or substantially in vertical planes containing the axles.

Because the bogey frame of the invention is articulated, it is possible to omit the primary suspension because each axle is associated with only one of the two half-frames.

Because there is no relative movement between each axle and the associated half-frame, it is possible to envisage a bogey structure in which each axle and associated half-frame constitutes a single unit which, if hollow, can also contain the transmission mechanism.

Figure 2:
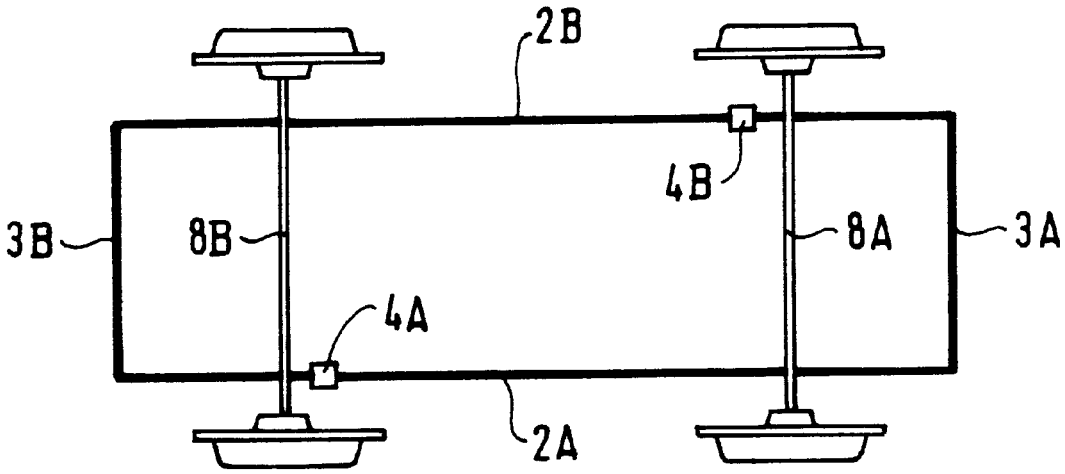
FIG. 2 is a diagram of the preferred embodiment of the bogey frame of the invention.
Figure 3:
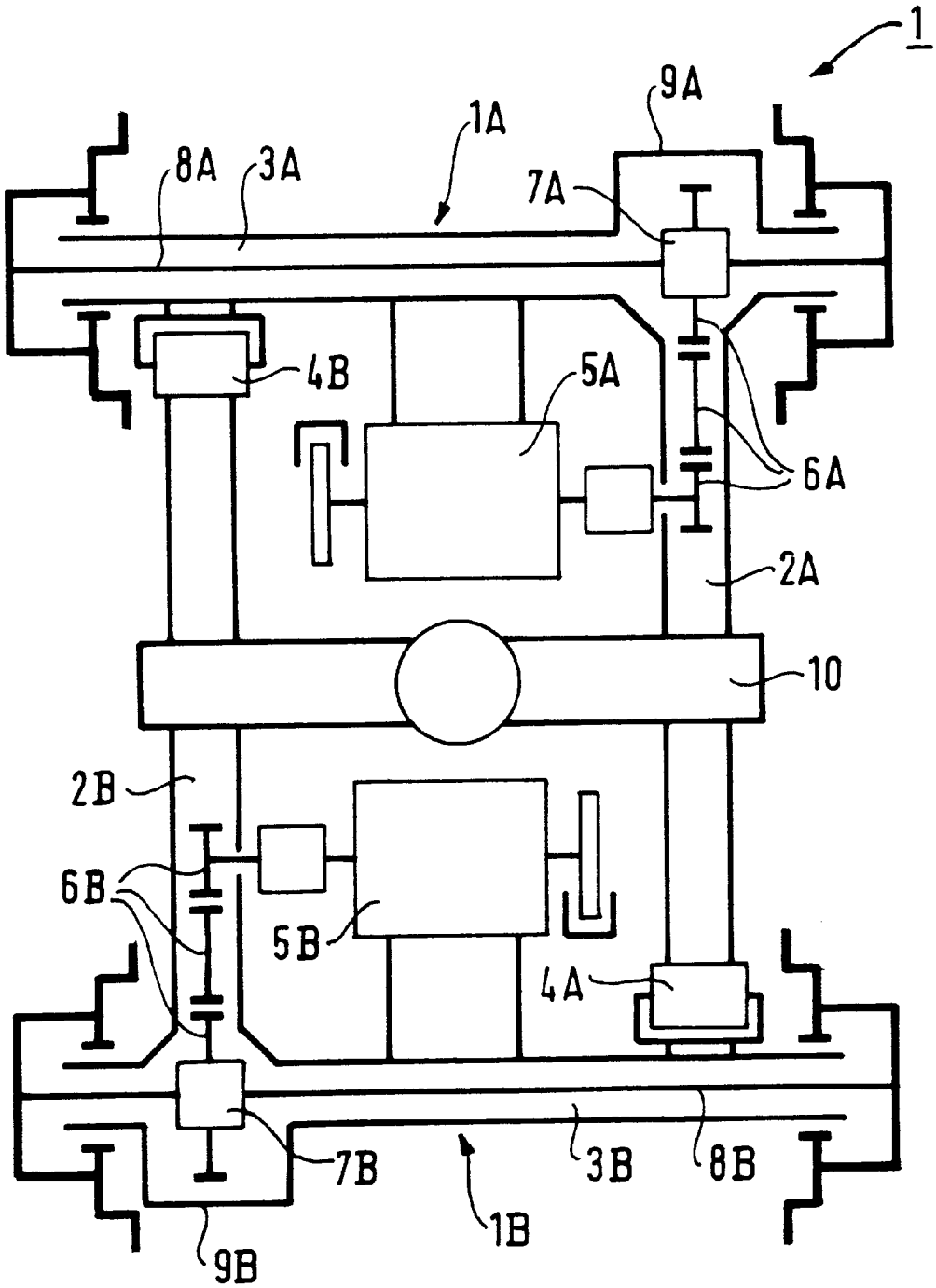
FIG. 3 is a diagram of another preferred embodiment of an articulated bogey including a frame of the invention.

FIGS. 2 and 3 are diagrams of the bogey frame of the invention.

The articulated bogey frame 1A, 1B of the invention comprises a right side beam 2A, a left side beam 2B, a front beam 3A, and a rear beam 3B.

Each of the right and left side beams 2A and 2B has one end secured to a respective one of the front and rear beams 3A and 3B.

First hinge means 4A, 4B are disposed between the other end of the right side beam 2A and the front or rear beam 3A or 3B, and second hinge means 4B, 4A are disposed between the other end of the left side beam 2B and the rear or front beam 3B or 3A.

The primary suspensions can be replaced by the hinge means 4A, 4B.

The right side beam 2A and the front beam 3A or rear beam 3B form a first half-frame 1A, and the left side beam 2B and the rear beam 3B or front beam 3A form a second half-frame 1B.

The first and second half-frames 1A and 1B are preferably identical.

From the above, it can be seen that a bogey 1 can be provided that has an articulated bogey frame 1A, 1B as described above.

The bogey of the invention therefore does not have primary suspension because the bogey frame is made of two half-frames that are interconnected by hinge means capable of accommodating relative movements due to track defects.

Each half-frame 1A, 1B supports a traction motor 5A, 5B, a set of gears 6A, 6B, a differential 7A, 7B, and an axle 8A, 8B.

FIG. 3 is a diagram showing more particularly an articulated bogey having a frame of the invention in which certain elements are integrated within the half-frames.

The sets of gears 6A, 6B, the differentials 7A, 7B, and the axles 8A, 8B are integrated in their respective half-frames 1A, 1B.

The sets of gears 6A, 6B can also be integrated at least in part within the respective intersections 9A, 9B between said right and left side beams 2A and 2B and the corresponding front and rear beams 3A and 3B.

The axles 8A, 8B can also be integrated in the corresponding front or rear beams 3A and 3B.

The differentials 7A and 7B can also be integrated within the respective intersections 9A and 9B between the right or left side beams 2A or 2B and the corresponding front or rear beams 3A or 3B.

Omission of the primary suspension and integration within each half-frame of the axles and the transmission elements provide the essential advantage of significant savings in mass, size, and cost.

The bogey generally includes a load-bearing center plate 10 secured to the right and left side beams 2A and 2B.

We claim:

1. A bogey comprising:

an articulated bogey frame including:

a right side beam, a left side beam, a front beam, a rear beam, and a hinge mechanism, the bogey frame being made up of two half-frames, with each of said half-frames being generally L-shaped, wherein one of the ends of each of said right and left side beams is secured to a respective one of said front and rear beams, and said hinge mechanism includes a first hinge disposed between the other end of said right side beam and said front or rear beam, and a second hinge disposed between the other end of said left side beam and said rear or front beam; and a traction motor, a set of gears, a differential, and an axle supported by each of said half-frames.

2. A frame according to claim 1, in which said generally L-shaped half-frames are hinged together by said hinge mechanism in or substantially in vertical planes containing the axles.

3. A frame according to claim 1, in which a primary suspension is replaced by said hinge mechanism.

4. A frame according to claim 1, in which said right side beam and said front or rear beam form a first half-frame, and said left side beam and said rear or front beam form a second half-frame.

5. A frame according to claim 1, in which said first and second half-frames are identical.

6. A bogey according to claim 1, including a load-bearing center plate secured to said right and left side beams.

7. A bogey according to claim 1, in which said sets of gears, said differentials, and said axles are integrated in their respective half-frames.

8. A bogey according to claims 7, in which said sets of gears are integrated at least in part within the respective intersections between said right and left side beams and said corresponding front and rear beams.

9. A bogey according to claimed 7, in which said axles are integrated in said respective front and rear beams.

10. A bogey according to claim 7, in which said differentials are integrated within the respective intersections between said right and left side beams and said respective front and rear beams.

* * * * *